US012298049B2

(12) United States Patent
Goel et al.

(10) Patent No.: US 12,298,049 B2
(45) Date of Patent: May 13, 2025

(54) SYSTEM AND METHOD FOR IDENTIFYING A REFRIGERANT LEAK IN MULTIPLE REFRIGERATION CIRCUITS WITH ONE OR MORE COMPRESSORS

(71) Applicant: Lennox Industries Inc., Richardson, TX (US)

(72) Inventors: Rakesh Goel, Irving, TX (US); Siddarth Rajan, Addison, TX (US); Vijay Kumar Sathyamurthi, Frisco, TX (US)

(73) Assignee: Lennox Industries Inc., Richardson, TX (US)

( * ) Notice: Subject to any disclaimer, the term of this patent is extended or adjusted under 35 U.S.C. 154(b) by 36 days.

(21) Appl. No.: 18/453,040

(22) Filed: Aug. 21, 2023

(65) Prior Publication Data

US 2025/0067487 A1 Feb. 27, 2025

(51) Int. Cl.

| | |
|---|---|
| ***F24F 11/36*** | (2018.01) |
| ***F25B 41/24*** | (2021.01) |
| ***F25B 41/40*** | (2021.01) |
| ***F25B 49/00*** | (2006.01) |

(52) U.S. Cl.

CPC ..... *F25B 49/005* (2013.01); *F25B 41/24* (2021.01); *F25B 41/40* (2021.01); *F25B 2400/06* (2013.01); *F25B 2500/222* (2013.01); *F25B 2700/195* (2013.01); *F25B 2700/197* (2013.01); *F25B 2700/21163* (2013.01); *F25B 2700/21175* (2013.01)

(58) Field of Classification Search

CPC . F24F 11/36; F25B 41/24; F25B 41/40; F25B 49/005; F25B 2400/06; F25B 2400/061; F25B 2500/222; F25B 2700/195; F25B 2700/197; F25B 2700/21163; F25B 2700/21175

See application file for complete search history.

(56) References Cited

U.S. PATENT DOCUMENTS 6,034,872 A * 3/2000 Chrysler ..... G06F 1/20 165/170

* cited by examiner

*Primary Examiner* — Jonathan Bradford

(74) *Attorney, Agent, or Firm* — Baker Botts L.L.P.

(57) ABSTRACT

A refrigeration system detects a refrigerant leak by detecting that a refrigerant concentration is more than a threshold concentration. In response, the system accesses subcool, superheat, and saturation suction temperature values associated with the compressor circuits. The system determines that the subcool value is less than a subcool threshold and whether the superheat value is more than a superheat threshold. In response, the system may determine that the compressor circuit associated with the subcool and superheat values is associated with the loss of charge. In response, the system isolates the compressor circuit from other components of the system and operates a blower. The system may continue cooling operation using non-leaking compressors.

20 Claims, 3 Drawing Sheets

SYSTEM AND METHOD FOR IDENTIFYING A REFRIGERANT LEAK IN MULTIPLE REFRIGERATION CIRCUITS WITH ONE OR MORE COMPRESSORS

TECHNICAL FIELD

The present disclosure relates generally to heating, ventilation, and air conditioning (HVAC) systems and methods of their use, and more specifically to a system and method for identifying a refrigerant leak in multiple refrigeration circuits with one or more compressors.

BACKGROUND

Heating, ventilation, and air conditioning (HVAC) systems are used to regulate environmental conditions within an enclosed space. Air is cooled or heated via heat transfer with refrigerant flowing through the system and returned to the enclosed space as conditioned air. During operation, refrigerant may leak from the working-fluid conduit subsystem or from one or more components.

SUMMARY

The system described in the present application provides several practical applications and technical advantages that overcome the current technical problems described herein. The following disclosure is particularly integrated into a practical application of improving refrigeration techniques by identifying and isolating circuits with a refrigerant leak while providing cooling using the refrigeration circuits which do not have a leak.

In general, the disclosed system improves the refrigeration technique by leveraging subcool (SC) values, superheat (SH) values, and (optionally) saturated suction temperature (SST) values to detect loss of charge, and in response, to determine that a set of conditions with respect to the SC, SH, and (optionally) SST values is met, determine a compressor circuit that is associated with the loss of charge, isolate the compressor circuit from other components of the heating, ventilation, and air conditioning (HVAC) system, execute a mitigation plan, and upon receiving a cooling demand, provide cooling by one or more other compressor circuits that are not associated with loss of charge.

In HVAC systems, particularly in rooftop unit (RTU) A2L HVAC systems with multiple compressor circuits, when a refrigerant leak is detected, it is not known which compressor circuit is associated with the refrigerant leak since the leak detection sensor is in the space shared by all compressor circuits. As a result, when a refrigerant leak is detected, in one approach, the HVAC system is shut-down and stops cooling operations. However, this approach is not efficient. For example, switching off the cooling unit of the HVAC system leads to a temperature rise in a room where the HVAC system is deployed, and therefore, discomfort for the people in the room. In another example, not utilizing other compressor circuits that are not associated with a refrigerant leak reduces the utilization efficiency of those compressor circuits.

This disclosure contemplates an unconventional system and method configured to leverage subcool, superheat, and saturated suction temperature values associated with different compressor circuits to detect which compressor circuit is associated with the loss of charge and therefore the refrigerant leak. For example, if a refrigerant leak is detected, the disclosed system may perform the following operations for each compressor circuit. For example, for each compressor circuit, the disclosed system may determine whether a subcool value, is less than a subcool threshold, a superheat value is greater than a superheat threshold, and optionally, if a saturation suction temperature is less than an SST threshold. If these conditions are met, the system may detect which compressor circuit is associated with the loss of charge and therefore the refrigerant leak. The disclosed system may then isolate the compressor circuit that is associated with the loss of charge. The disclosed system may also execute a mitigation plan to run/operate the blower to reduce the refrigerant concentration due to the refrigerant leak. Upon receiving an air conditioning request, the disclosed system may provide air conditioning using one or more other compressor circuits that are not associated with the loss of charge. The leak detection process and isolating of the refrigeration circuit may not affect the air conditioning operations of the HVAC system. Thus, the HVAC system is able to provide seamless air conditioning before, during, and after the detection of the leak. In other words, the HVAC system takes the air conditioning operation load from the refrigeration circuit that is associated with the leak and puts on (e.g., distributes) the air conditioning operation load among circuit(s) that are not associated with the refrigerant leak.

Accordingly, the disclosed system provides a practical application of improving refrigeration techniques by detecting which compressor circuit is responsible for, associated with, and contributes to the loss of charge and refrigerant leak, isolating the identified refrigeration circuit, and using other refrigeration circuit(s) to provide air conditioning. The disclosed system further provides an additional practical application of load balancing among the compressors, where the air conditioning operation load is balanced among compressor(s) that are not associated with the refrigerant leak and taken from those compressors that are associated with the refrigerant leak. The disclosed system further provides an additional practical application of identifying a location where the refrigerant leak has occurred, and a component associated with the leak.

In certain embodiments, an HVAC system comprises a set of refrigeration circuits, each with one or more compressors, a condenser, a subcool sensor circuit, a superheat sensor circuit, a refrigerant detection sensor circuit that is common to all the refrigeration circuits, and a processor. The set of refrigeration circuits comprises a first refrigeration circuit and a second refrigeration circuit. The first refrigeration circuit consists of one or more compressors configured to receive a first flow of a first refrigerant from a first evaporator coil and to discharge the first flow of refrigerant at a first higher pressure. The second refrigeration circuit consists of one or more compressors configured to receive a second flow of a second refrigerant from a second evaporator coil and to discharge the second flow of the second refrigerant at a second higher pressure. The condenser is configured to receive the first refrigerant and cool the first refrigerant flowing through. The subcool sensor circuit is configured to provide a subcool signal that indicates to a subcool value associated with the condenser, wherein the subcool value corresponds to a temperature difference between a saturated refrigerant and a subcooled refrigerant associated with the condenser. The superheat sensor circuit is configured to provide a superheat signal that indicates a superheat value corresponding to a temperature difference between a superheated refrigerant and a saturated refrigerant state associated with the evaporator pressure. The refrigerant detection sensor circuit is configured to detect a concentration of the first refrigerant in a volume. One or more processors could be operably coupled to the refrigerant detection sensor, a part of the sensor, on a separate control board connected to the sensor, or reside in both, the sensor and a separate control board. The processors are further operably coupled to the subcool sensor, and the superheat sensor. The processor is configured to receive sensor data from the refrigerant detection sensor, wherein the sensor data indicates the detected concentration of the first refrigerant in the volume. The processor is further configured to compare the detected concentration of the first refrigerant with a threshold concentration. The processor is further configured to determine that the detected concentration of the first refrigerant exceeds the threshold concentration. In response to determining that the detected concentration of the first refrigerant exceeds the threshold concentration, the processor is further configured to receive the subcool signal from the subcool sensor. The processor is further configured to determine the subcool value based at least in part upon the subcool signal. The processor is further configured to receive the superheat signal from the superheat sensor. The processor is further configured to determine the superheat value based at least in part upon the superheat signal. The processor is further configured to determine that the subcool value is less than a threshold subcool value. The processor is further configured to determine that the superheat value is more than a threshold superheat value. In response to determining that the subcool value is less than the threshold subcool value and that the superheat value is more than the threshold superheat value, the processor is further configured to determine that the first refrigerant is leaking from the first compressor, isolate the first refrigeration circuit from other components of the HVAC system, execute a mitigation plan to reduce a leak of the first refrigerant from the first compressor, and allow the remaining refrigeration circuits to operate independently to serve the space conditioning demands as they arise.

Certain embodiments of this disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
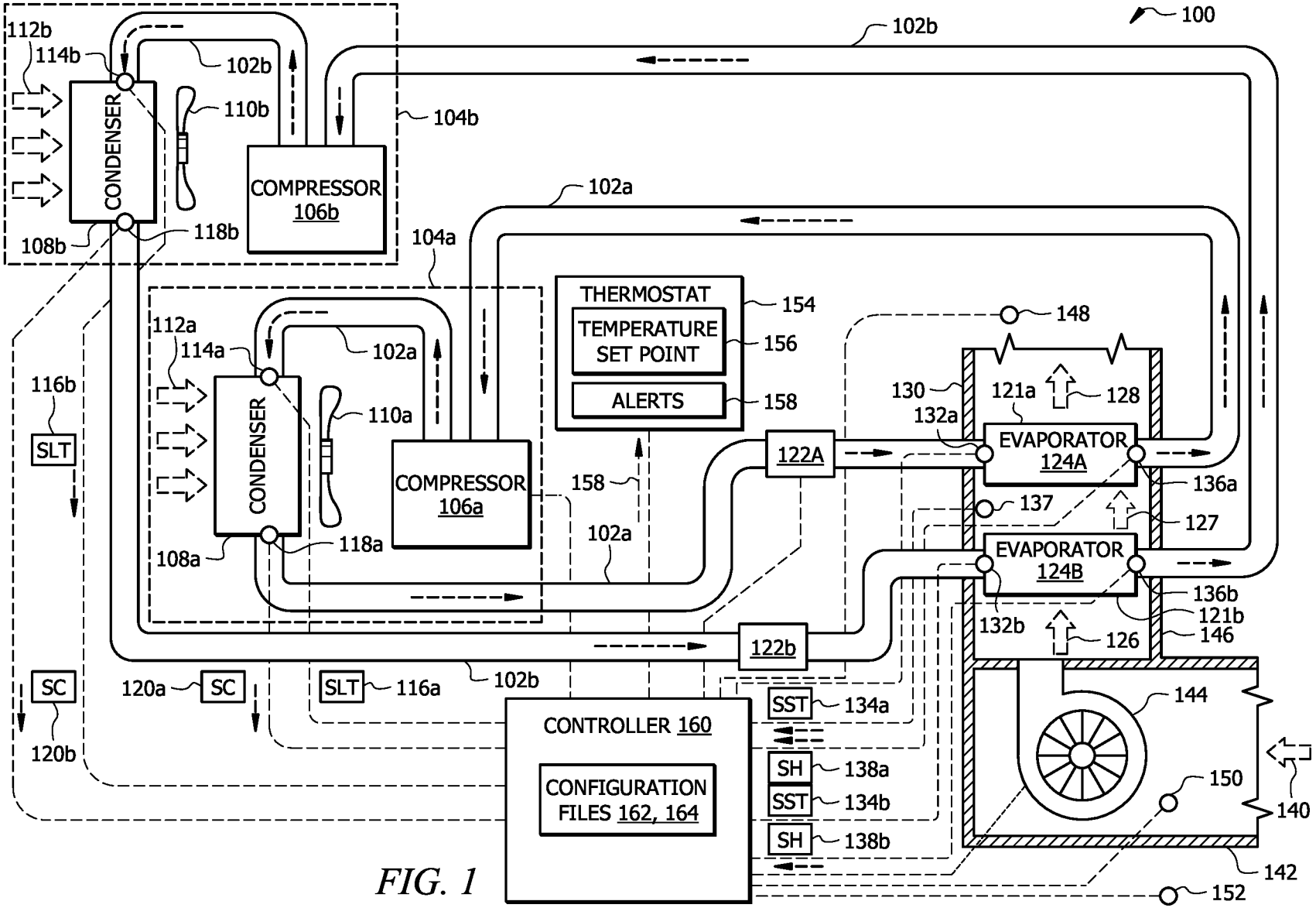
FIG. 1 illustrates a diagram of an example HVAC system.
Figure 2:
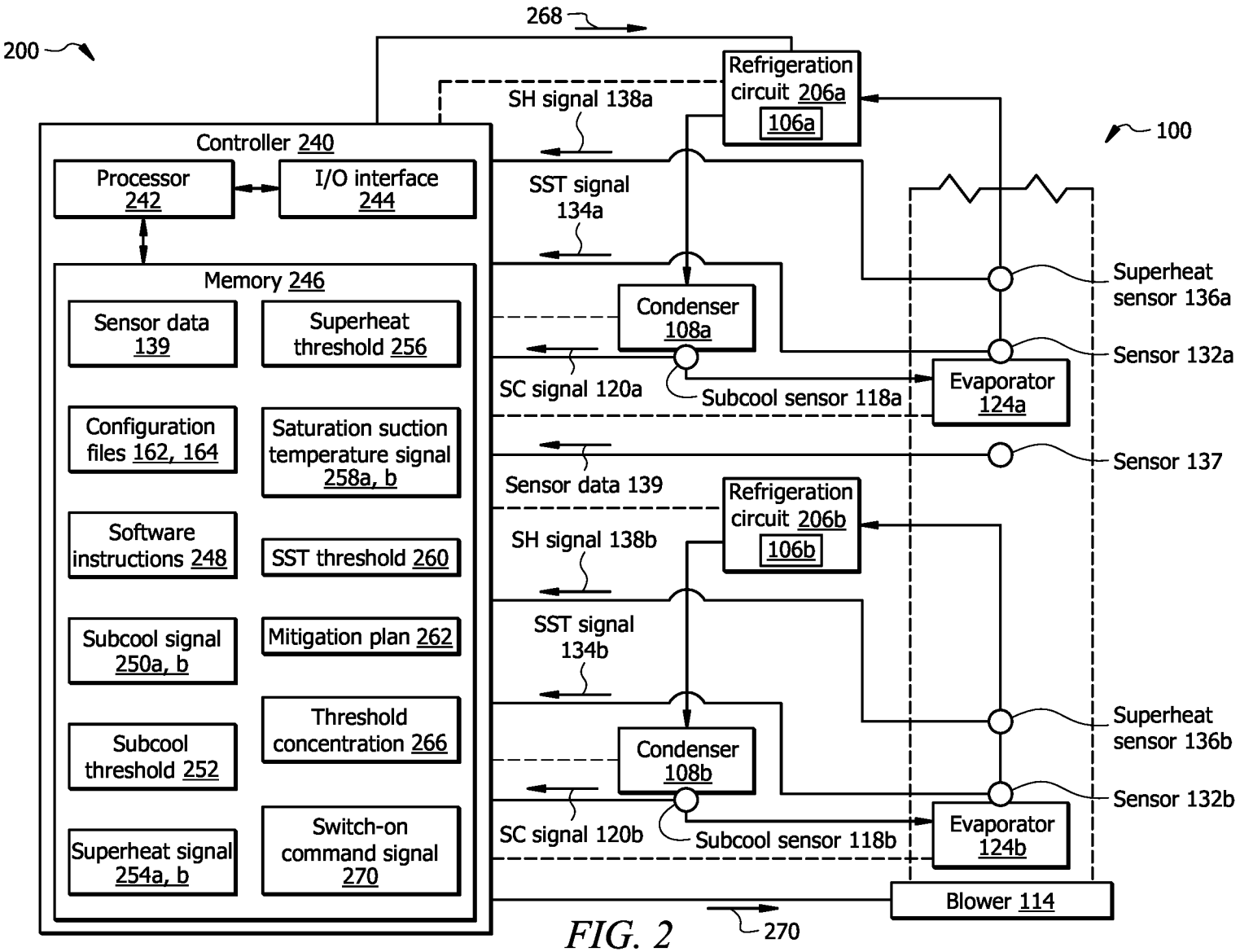
FIG. 2 illustrates a diagram of an example system configured to facilitate effective refrigerant leak identification by leveraging superheat signal, subcool signal, and saturated suction temperature in the HVAC system of FIG. 1.
Figure 3:
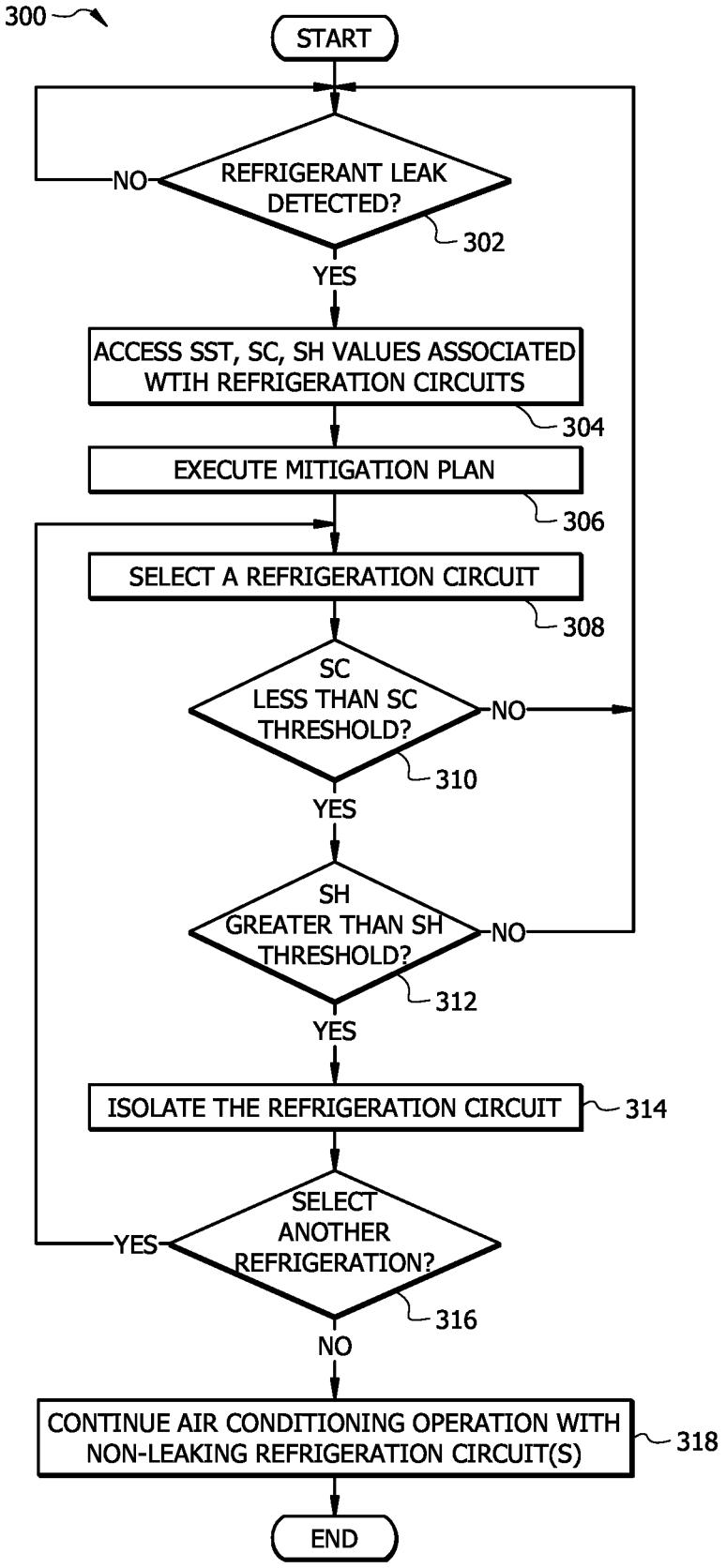
FIG. 3 illustrates a flowchart illustrating an example method for providing air conditioning during refrigerant leak in the HVAC system of FIG. 1.

As described above, previous technologies fail to provide an efficient, secure, and reliable solution to facilitate a more effective refrigerant leak identification by leveraging superheat signal, subcool signal, and saturated suction temperature in a refrigeration system, for example, in Heating, Ventilation, and Air Conditioning (HVAC) systems. Embodiments of the present disclosure and its advantages may be understood by referring to FIGS. 1 through 3. FIGS. 1 through 3 are used to describe systems and methods to facilitate effective refrigerant leak identification by leveraging superheat signal, subcool signal, and saturated suction temperature in the HVAC system.

System Overview

FIG. 1 is a schematic diagram of an embodiment of an HVAC system 100 configured to facilitate a more effective refrigerant leak identification by leveraging superheat signal, subcool signal, and saturated suction temperature, and provide air conditioning using multi-compressor circuit system even when one or more refrigerants leak associated with one or more compressor circuits is detected. The HVAC system 100 may further be configured to detect side faults (e.g., an overcharge or undercharge of working fluid). The HVAC system 100 may further be configured to regulate a temperature of a space. The HVAC system 100 conditions air for delivery to a conditioned space. The conditioned space may be, for example, a room, a house, an office building, a warehouse, or the like. In some embodiments, the HVAC system 100 is a packaged unit such as a rooftop unit (RTU) that is positioned on the roof of a building and the conditioned air is delivered to the interior of the building. In other embodiments, portion(s) of the system may be located within the building and portion(s) outside the building such as split systems used in commercial and residential applications. The HVAC system 100 may include one or more heating elements, not shown for convenience and clarity. The HVAC system 100 may be configured as shown in FIG. 1 or in any other suitable configuration. For example, the HVAC system 100 may include additional components or may omit one or more components shown in FIG. 1.

The example HVAC system 100 includes at least two compression circuits which can generally be operated independently. The first compression circuit includes a first working-fluid conduit subsystem 102*a*, at least one condensing unit 104*a*, an expansion valve 122*a*, and an evaporator 124*a*. The second compression circuit includes a second working-fluid conduit subsystem 102*b*, at least one condensing unit 104*b*, an expansion valve 122*b*, and an evaporator 124*b*. The HVAC system 100 also includes a thermostat 154 and a controller 160.

The HVAC system 100 is generally configured to determine refrigerant leakages, loss of charge (i.e., loss of refrigerant) by monitoring properties of the HVAC system, as described in greater detail below. For instance, subcool signals 120*a,b* and superheat signals 138*a,b* (described in greater detail below) may be used to detect refrigerant leaks and determine whether the HVAC system is overcharged or undercharged with working fluid. In an example operation of HVAC system 100, subcool signals 120*a, b*, respectively, from subcool sensor circuits 118*a,b*, are used to monitor the performance of HVAC system 200. During operation of condenser coil, it may be beneficial to ensure that refrigerant output to the evaporator coil 121*a,b* is entirely in the liquid phase (i.e., that no vapor-phase refrigerant is allowed to enter the evaporator coil 121*a,b*).

The subcool sensor circuit 118*a,b* may be configured to provide a subcool signal 120*a,b* that indicates to a subcool value associated with the condenser 108*a,b*, respectively. The subcool value may correspond to a temperature difference between a saturated refrigerant and a subcooled refrigerant associated with the condenser 108*a,b*. A combination of pressure and temperature sensors could be used, for e.g., a pressure sensor is used to measure the pressure in the condenser which is then used to determine the saturation liquid temperature which is then used to determine subcooling. The first subcool value associated with the first condenser 108*a* is measured via the subcool signal 120*a* received from the first subcool sensor circuit 118*a*. Similarly, the second subcool value associated with the second condenser 108*b* is measured via the subcool signal 120*b* received from the second subcool sensor circuit 118*b*. Each subcool value may be measured or determined using a calibration file 162 (e.g., a lookup table) generated during calibration of the respective sensor 118*a,b* to confirm (e.g., continuously during operation) that an appropriate subcool value is achieved that corresponds to a fully liquid phase refrigerant output from the condenser coil 108*a,b*. This prevents possible damage to the expansion valve 122*a, b* caused by flow of a vapor phase fluid through the expansion valve 122*a,b*. A desired subcool value for optimal condenser coil 108*a,b* performance is generally more than a range from about 5 to about 10° F. When the subcool value is less than this range, for example, if the subcool value is between about 0 to 3° F., there may be a refrigerant leak at the condenser coil 108*a,b* which causes the condenser could 108*a,b* not be performing as intended.

In another example operation of the HVAC system 100, a subcool signal 120*a,b* is used to detect a loss of charge in the HVAC system 100 (e.g., to detect a loss or leak of refrigerant from the HVAC system 200). For example, as described in greater detail with respect to system 200 and method 300 below, the subcool value may be determined by accessing a calibration file 162 (e.g., a lookup table) for the subcool sensor circuit 118*a, b* and identifying a subcool value (e.g., in degrees Fahrenheit) that corresponds to the subcool signal 120*a, b*, respectively. The controller 160 then determines whether the measured subcool value is less than a threshold subcool value (e.g., of about range between 0 to 3° F.) corresponding to a likely loss of charge. If the measured subcool value is less than or equal to the threshold range, the controller 160 determines that a loss of charge has occurred. The controller 160 may transmit an alert signal 158 to the thermostat 154 indicating this loss of charge. The alert signal may also or alternatively be transmitted to a service center or a device of a service technician such appropriate corrective steps may be taken to repair the system 100.

In the same or another example operation of the HVAC system 100, accessing, fetching, and/or recording the subcool signal 120*a,b* may be in response to detecting a refrigerant leak associated with a compressor 106*a,b*. For example, when a refrigerant leak is detected with respect to the compressor 106*a*, the subcool value indicated by the subcool signal 120*a* may be less than the threshold subcool. Similarly, when a refrigerant leak is detected with respect to the compressor 106*b*, the subcool indicated by the subcool signal 120*b* may be less than the threshold subcool. The determined subcool values and signals 120*a,b* may be used to determine the loss of charge, and isolate a compressor 106*a,b* that is associated with the refrigerant leak from other components of the HVAC system 100. Generally, as the charge of refrigerant in the HVAC system 100 is increased, the subcool value increases.

In another example operation of HVAC system 100, superheat signals 138*a,b*, respectively, received from superheat sensors 136*a, b* are used to monitor the performance of HVAC system 200. The superheat sensor circuit 136*a,b*, may be configured to provide a superheat signal 138*a,b* that indicates a superheat value corresponding to a temperature difference between a superheated refrigerant and a saturated refrigerant associated with the evaporator. A combination of pressure and temperature sensors could be used, for e.g., a pressure sensor is used to measure the pressure in the condenser which is then used to determine the saturation vapor temperature which is then used to determine superheating. For example, the controller 160 may determine a superheat value using the superheat signal 138*a,b* received from the superheat sensor 136*a,b* and use the superheat value to detect a loss of charge. For example, as described in greater detail with respect to system 200 and method 300 below, the superheat value may be determined by accessing a calibration file 164 (e.g., a lookup table) for the corresponding superheat sensor circuit 136*a,b* and identifying a superheat value (e.g., in degrees Fahrenheit) that corresponds to the superheat signal 138*a,b*, respectively. A preferred superheat value may be more than a range from about 5 to about 10° F. When the superheat value exceeds a certain temperature threshold (e.g., of greater than about 25 to 30° F.), no additional benefit is provided by the evaporator coil 121*a,b* (i.e., no improvement to the performance of system 100 is achieved). This may be an indication of a refrigerant leak and loss of charge associated with the compressor circuit 106*a,b*. To prevent this wasted superheating and the associated waste of energy, the controller 160 may transmit an alert signal 158 to the thermostat 154 when the superheat value exceeds an efficiency threshold (e.g., of about 25 to 30° F.)

If the superheat value exceeds a maximum threshold (e.g., of about 25 to 30° F.) and the subcool value is less than a minimum threshold (e.g., of about 0 to 3° F.), this may be an indication of loss of charge, for example, as a result of refrigerant leak at and associated with a compressor circuit 106*a,b*. Thus, if these conditions are met, the HVAC system 200 likely requires immediate attention. In some embodiments, if these conditions of superheat value and subcool value are met, the controller is operable to automatically isolate the particular compressor circuit(s) 106*a,b* that is determined to be associated with the loss of charge and refrigerant leak. For example, the controller 160 may switch off the particular compressor circuit(s) 106*a,b* and optionally close shut-off valves outlet and/or inlet to the particular compressor circuit(s) 106*a,b* to prevent damage to the HVAC system 100 or unnecessary expenditure of energy when the system 100 is not functioning properly. The controller 160 may also execute a mitigation plan that includes switching on the blower 144 by sending a turn-on command signal to the blower 144. The controller 160 may continue to provide air conditioning using one or more other compressor(s) 106*a, b* that are not associated with the loss of charge and refrigerant leak.

In some embodiments, the superheat value may be used to diagnose other performance issues of the HVAC system 100. For example, the superheat value may be monitored over time for gradual loss of charge or leak detection. For example, a relatively slow drift in the superheat value over time may be indicative of a slow leak of refrigerant form the system 100. In some embodiments, subcool value is monitored as a first measure of loss of charge, and superheat is monitored as a secondary measure. This is because when loss of charge occurs, the subcool value generally first goes to 0° F. before the superheat value begins to increase.

In another example operation of the HVAC system 100, a subcool signal 118*a,b* from sensor 118*a,b* and/or a superheat signal 138*a,b* from sensor 136*a,b* is used to improve the performance of the overall HVAC system 100. For example, measured subcool values and/or superheat values may be used to reduce the loss of charge and faster detection of refrigerant leak. For example, when it is determined that the superheat value exceeds a maximum threshold (e.g., of about 25 to 30° F.) and the subcool value is less than a minimum threshold (e.g., of about 0 to 3° F.), an alert message may be sent to a user device of a technician, where the alert message may indicate that loss of charge is detected with respect to the compressor circuit(s) 106*a,b* and that the HVAC system 100 needs service. In another example, to conserve the charge and energy, the compressor circuit 106*a,b* that is determined to be associated with the loss of charge may be switched off. In another example, the controller 160 may adjust the speed of one or more of the fan 110*a,b*, and the blower 114 to improve system performance. For example, if the controller 160 determines that the first compressor circuit 106*a* is associated with the loss of charge, the controller 160 may switch off the compressor circuit 106*a*, use the compressor circuit 106*b* to provide space conditioning or air conditioning, and (optionally) cause the speed of the fan 110*b* to increase in order to provide more air conditioning to the refrigerant passing through the condenser coil 122*b*. For example, the speed of the fan 110*b* may be increased by a predetermined amount (e.g., corresponding to a speed increase of about 10%) or an amount proportional to the difference between the measured subcool value and a predefined target subcool value (e.g., more than 5 F). After the speed of the fan 110*b* is increased, the subcool value will continue to be monitored to determine if further adjustment in the speed of fan 110*b* is needed to reach the target subcool value. A similar approach may be used to adjust the speed of the blower 144 and/or the compressor circuit 106*b* to obtain a target subcool value, based on the subcool signal 120*b*. Similarly, if the controller 160 determines that the superheat value is greater than a performance threshold (e.g., of about 25 to 30° F.), the controller 160 may determine that further heating of the refrigerant in the evaporator coil is not required and cause the speed of the blower 144 to decrease to conserve energy. The speed of the blower 144 may be decreased by a predetermined amount (e.g., of about 10%) or an amount proportional to the difference between the measured superheat value and the performance threshold value. For example, the speed of the compressor 106*a* may be decreased gradually until the superheat value is equal to or less than the performance threshold.

It should be understood that the temperature difference sensors described in the present disclosure are not limited to measuring refrigerant temperature differences in the condenser coil 108*a,b* and evaporator coil 122*a,b*. One or more additional or alternate temperature difference sensors may be employed to measure any relevant temperature difference in the HVAC system 100 such as the temperature difference between return airflow 220 and conditioned airflow 216, which can also be used to monitor and optimize the performance of the HVAC system 200.

Each of the working fluid conduit subsystems 102*a, b* facilitates the movement of a working fluid (e.g., a refrigerant) through an air conditioning cycle such that the working fluid flows as illustrated by the dashed arrows in FIG. 1. The working fluid may be any acceptable working fluid including, but not limited to, fluorocarbons (e.g., chlorofluorocarbons), ammonia, non-halogenated hydrocarbons (e.g., propane), hydroflurocarbons (e.g., R-410A), or any other suitable type of refrigerant.

Each of the condensing units 104*a,b* includes at least one compressor 106*a,b*, a condenser 108*a,b*, and a fan 110*a,b*. In some embodiments, one or both of the condensing units 104*a,b* is an outdoor unit while other components of system 100 may be indoors. The compressor 106*a,b* is coupled to the corresponding working-fluid conduit subsystem 102*a,b* and compresses (i.e., increases the pressure of) the working fluid. The compressors 106*a,b* may be single-speed, variable-speed or multi-stage compressors. A variable-speed compressor is generally configured to operate at different speeds to increase the pressure of the working fluid to keep the working fluid moving along the working-fluid conduit subsystem 102*a,b*. In the variable-speed compressor configuration, the speed of compressor 106*a,b* can be modified to adjust the air conditioning capacity of the HVAC system 100. Meanwhile, in the multi-stage compressor configuration, one or more compressors can be turned on or off to adjust the air conditioning capacity of the HVAC system 100. The compressor 106 of condensing unit 104 may be a variable speed compressor, a multi-speed compressor, a multi-stage compressor, among other types. In some embodiments, the compressor 106 may be connected to another compressor 106 in a HVAC unit. In some embodiments, multiple compressors 106 may be tandem compressors, each separately compressing the refrigerant and delivering the refrigerant to a common discharge manifold. In some embodiments, one or more compressors 106 may serve a single refrigeration circuit. In some embodiments, one or more compressors 106 may serve multiple refrigeration circuits.

Each compressor 106*a,b* is configured to receive a flow of refrigerant from a respective evaporator coil 121*a,b* and to discharge the flow of refrigerant at a respective higher pressure. For example, the compressor 106*a* may be configured to receive a first flow of a first refrigerant from the evaporator coil 121*a* and discharge the first flow of the first refrigerant at a first higher pressure, and the compressor 106*b* may be configured to receive a second flow of a second refrigerant from the evaporator coil 121*b* and discharge the second flow of the second refrigerant at a second higher pressure.

Each compressor 106*a,b* is in signal communication with the controller 160 using wired or wireless connection. The controller 160 provides commands or signals to control operation of the compressor 106*a,b* and/or receives signals from the compressor 106 corresponding to a status of the compressor 106*a,b*. For example, when a compressor 106*a,b* is a variable-speed compressor, the controller 160 may provide signals to control the compressor speed. When a compressor 106*a,b* operates as a multi-stage compressor, the signals may correspond to an indication of which compressors to turn on and off to adjust the compressor 106*a,b* for a given heating capacity, or in general, air conditioning capacity. The controller 160 may operate the compressor 106 in different modes corresponding to load conditions (e.g., the amount of cooling or heating required by the HVAC system 100).

Each condenser 108*a,b* is configured to facilitate movement of the working fluid through the corresponding working-fluid conduit subsystem 102*a,b*. Each condenser 108*a,b* is further configured to receive the respective refrigerant and cool the refrigerant flowing therethrough. For example, the condenser 108*a* is configured to receive the first refrigerant and cool the first refrigerant flowing therethrough, and the condenser 108*b* is configured to receive the second refrigerant and cool the second refrigerant flowing therethrough. Each condenser 108*a,b* is generally located downstream of the compressor 106*a,b* from the corresponding compression circuit and is configured to remove heat from the working fluid. Each fan 110*a,b* is configured to move air 112*a,b* across the condenser 108*a,b* from the corresponding compression circuit. For example, a fan 110*a,b* may be configured to blow outside air through the condenser 108*a,b* to help cool the working fluid flowing therethrough. The compressed, cooled working fluid flows from the condenser 108*a,b* toward an expansion device 122*a,b* of the corresponding compression circuit.

Each condenser 108*a,b* includes a corresponding first sensor 114*ab* and a second sensor 118*a,b*. In the example of FIG. 1, each first sensor 114*a,b* may be configured to measure a saturated liquid temperature of working fluid flowing in the condenser 108*a,b* and provide a corresponding saturated liquid temperature signal ("SLT") 116*a,b* to the controller 160. For example, a first sensor 114*a,b* may be a temperature sensor such as a thermocouple or a thermistor. In some embodiments, a first sensor 114*a,b* is a pressure sensor (e.g., to measure a saturation temperature indirectly via a measure of saturation pressure). Similarly, each second sensor 118*a,b* may be configured to measure a liquid temperature of working fluid flowing in the condenser 108*a,b* and provide a corresponding liquid temperature signal ("LT") 120*a,b* to the controller 160. For example, a second sensor 120*a,b* may be a temperature sensor such as a thermocouple or a thermistor.

The first sensor 114*a,b* may be located approximately at the center of the length of a circuit of the condenser 108*a,b*. This location may correspond to a position where working fluid flowing through the condenser 108*a,b* is a saturated liquid. Alternatively, a pressure sensor 114*a,b* could be located at the outlet of the condenser to determine the pressure which can then be used to estimate a saturated liquid temperature. The second sensor 118*a,b* may be located on or near an exit of a subcool circuit 118*a,b* of the condenser 108*a,b* or on a fluid line (i.e., on or in the working-fluid conduit subsystem 102*a,b*) just after the outlet of the condenser 108*a,b*. Sensors 114*a,b* and 118*a,b* may generally be attached on or within the condenser 108*a,b* and/or working-fluid conduit subsystem 102*a,b* using any appropriate means (e.g., clamps, adhesives, or the like).

Each expansion device 122*a,b* is coupled to the corresponding working-fluid conduit subsystem 102*a,b* downstream of the condenser 108*a,b* and is configured to remove pressure from the working fluid. In this way, the working fluid is delivered to the evaporator 124*a,b* of the compression circuit and receives heat from airflow 126 to produce a conditioned airflow 128 that is delivered by a duct subsystem 130 to the conditioned space. In general, an expansion device 122*a,b* may be a valve such as an expansion valve or a flow control valve (e.g., a thermostatic expansion valve) or any other suitable valve for removing pressure from the working fluid while, optionally, providing control of the rate of flow of the working fluid. An expansion device 122*a,b* may be in communication with the controller 160 (e.g., via wired and/or wireless communication) to receive control signals for opening and/or closing associated valves and/or provide flow measurement signals corresponding to the rate of working fluid flow through the working fluid subsystem 102*a,b*.

The evaporator 124*a,b* of each compression circuit is generally any heat exchanger configured to provide heat transfer between air flowing through the evaporator 124*a,b* (i.e., air contacting an outer surface of one or more coils of the evaporator 124*a,b*) and working fluid passing through the interior of the evaporator 124*a,b*. For example, the evaporator 124*a,b* may be or include one or more evaporator coils 122*a,b*, respectively. In some embodiments, evaporators 124*a,b* are combined in a single coil unit. Airflow 126 flows first through evaporator 124*a* before flowing through evaporator 124*b* and being output as conditioned airflow 128. A portion of airflow 126 flows through evaporator 124*a* while a separate portion of airflow 126 flows through evaporator 124*b*.

Each evaporator 124*a,b* is fluidically connected to the compressor 106*a,b* of the corresponding compression circuit, such that working fluid generally flows from the evaporator 124*a,b* to the corresponding condensing unit 104*a,b*. A portion of the HVAC system 100 is configured to move air 126 across the evaporators 124*a,b* and out of the duct sub-system 130 as conditioned airflow 128. Return air 140*a,b*, which may include outdoor air 140*a*, indoor air 140*b* returning from the building, or some combination, is pulled into a return duct 142. A device 141 may be positioned on or in the duct 142 and include one or more dampers for modulating the amount of outside air 140*a* pulled into the return duct 142. When the HVAC system 100 is a rooftop unit (RTU), device 141 may be referred to as an economizer. Duct 142 may include additional dampers (not illustrated for clarity and conciseness), which may be configured, for example, to adjust the amount of indoor air 140*b* pulled into the duct 142.

Each evaporator 124*a,b* includes a corresponding third sensor 132*a,b*, a fourth sensor 136*a,b*, and fifth sensor(s) 137. In the example of FIG. 1, each third sensor 132*a,b* may be configured to measure a saturated suction temperature of working fluid flowing in the evaporator 124*a,b* and provide a corresponding saturated suction temperature signal ("SST") 134*a,b* to the controller 160. For example, a third sensor 132*a,b* may be a temperature sensor such as a thermocouple or a thermistor. In some embodiments, a third sensor 132*a,b* is a pressure sensor (e.g., to measure a saturation temperature indirectly via a measure of saturation pressure). Similarly, in some embodiments, each fourth sensor 136*a,b* may be configured to measure a suction temperature of working fluid flowing in the evaporator 124*a,b* and provide a corresponding suction temperature signal ("ST") to the controller 160. In some embodiments, each fourth sensor 136*a,b* may also or alternatively be configured to determine the superheat signal 138*a,b*. The SST signal refers to the temperature of the refrigerant vapor as it enters the compressor 106*a,b*. This temperature may be measured using a sensor 136*a,b* placed at the suction line of the compressor 106*a,b*. The superheat signal 138*a,b* may indicate the level of superheat in the refrigerant vapor. Superheat refers to the temperature of the refrigerant vapor above its saturation temperature at a given pressure. The controller 160 may use the ST signal as a reference point to determine the superheat value. For example, by comparing the ST signal with the saturation temperature corresponding to the refrigerant's pressure, the superheat value may be calculated. In one example, a fourth sensor 136*a,b* may be a temperature sensor such as a thermocouple or a thermistor. Each sensor circuit 132*a,b*, 136*a,b*, and 137 may be implemented by a hardware sensor circuitry. One or more sensor circuits 137 may be positioned at any location within the HVAC system 100. the sensor circuit 137 may be any suitable sensor and/or collection of equipment operable to detect a concentration of refrigerant, air temperature, air pressure, among others. Without limitations, each sensor circuit 137 may be one or more of a gas sensor circuit, temperature sensor circuit, speed of sound sensor circuit, pressure sensor circuit, thermal conductivity sensor circuit, heated diode leak detector circuit, or any combination thereof. In some embodiments where a sensor circuit 137 is configured to detect refrigerant, the sensor circuit 137 may be interchangeably referred to herein in as a refrigerant detection sensor circuit 137. In some embodiments, the sensor circuits 132*a,b*, 136*a,b*, and 137 may be in signal communication with a controller 160 using a wired or wireless connection.

As shown in this illustrative example, the third sensor 132*a,b* may be located approximately on or near an end of a distributor line (e.g., a line from the outlet of the expansion device 122*a,b* to the inlet of the evaporator 124*a,b*). This location may correspond to a position where working fluid flowing through, or into, the evaporator 124*a,b* is a saturated vapor. The fourth sensor 136*a,b* may be located on or near the outlet of the evaporator 124*a,b*. For instance, a fourth sensor 136*a,b* may be located in a portion of the evaporator 124*a,b* containing a super-heated vapor working fluid or on a portion of the working-fluid conduit subsystem 102*a,b* leading towards the suction side of the compressor 106*a,b*. Sensors 132*a,b* and 136*a,b* may generally be attached on or within the evaporator 124*a,b* and/or working-fluid conduit subsystem 102*a,b* using any appropriate means (e.g., clamps, adhesives, or the like). The sensor 137 may be located at any location within the HVAC system 100, for example, upstream a compressor circuit 106*a,b*, downstream a compressor circuit 106*a,b*. upstream a evaporator 124*a,b*, downstream a evaporator 124*a,b*, respectively, among other locations.

A suction side of a blower 144 pulls the return air 140*a,b*. The blower 144 discharges airflow 126 into a duct 146 such that airflow 126 crosses the evaporators 124*a,b* or heating elements (not shown) to produce conditioned airflow 128. The blower 144 is any mechanism for providing a flow of air through the HVAC system 100. For example, the blower 144 may be a constant-speed or variable-speed circulation blower or fan. Examples of a variable-speed blower include but are not limited to, belt-drive blowers controlled by inverters, direct-drive blowers with electronic commuted motors (ECM), or any other suitable type of blower. The blower 144 is in signal communication with the controller 160 using any suitable type of wired or wireless connection. The controller 160 is configured to provide commands and/or signals to the blower 144 to control its operation (e.g., to adjust the airflow to operate at a prescribed CFM/ton value during a validation mode). The blower 144 may be a motor-driven component. The blower 144 may be positioned in a duct system and configured to move airflow across an indoor coil and out of the duct system.

The HVAC system 100 includes one or more sensors 148, 150, 152 in signal communication with the controller 160. The sensors 148, 150, 152 may include any suitable type of sensor for measuring air temperature, relative humidity, and/or any other properties of the conditioned space (e.g. a room or building), the HVAC system 100, and/or the surrounding environment (e.g., outdoors). The sensors 148, 150, 152 may be positioned anywhere within the conditioned space, the HVAC system 100, and/or the surrounding environment. For example, as shown in the illustrative example of FIG. 1, the HVAC system 100 may include a sensor 150 positioned and configured to measure a return air temperature (e.g., of airflow 140) and/or a sensor 148 positioned and configured to measure a supply or treated air temperature (e.g., of airflow 128), a temperature of the conditioned space, and/or a relative humidity of the conditioned space. The HVAC system includes a sensor 152 positioned and configured to measure an outdoor air temperature and/or other properties of the outdoor environment (e.g., relative humidity). In other examples, the HVAC system 100 may include sensors positioned and configured to measure any other suitable type of air temperature (e.g., the temperature of air at one or more locations within the conditioned space) or other property (e.g., a relative humidity of air at one or more locations within the conditioned space).

The HVAC system 100 includes a thermostat 154, for example, located within the conditioned space (e.g. a room or building). The thermostat 154 is generally in signal communication with the controller 160 using any suitable type of wired or wireless connection. The thermostat 154 may be a single-stage thermostat, a multi-stage thermostat, or any suitable type of thermostat. The thermostat 154 is configured to allow a user to input a desired temperature or temperature setpoint 156 of the conditioned space for a designated space or zone such as a room in the conditioned space. The controller 160 may use information from the thermostat 154 such as the temperature setpoint 156 for controlling the compressors 106*a,b* and/or the blower 144. In some embodiments, the thermostat 154 includes a user interface for displaying information related to the operation and/or status of the HVAC system 100, such as one or more alert signals 158. For example, the user interface may display operational, diagnostic, and/or status messages and provide a visual interface that allows at least one of an installer, a user, a support entity, and a service provider to perform actions with respect to the HVAC system 100.

As described in greater detail below, the controller 160 is configured to perform any of the function described in this disclosure, as described both above and in greater detail below with respect to system 200 of FIG. 2 and method 300 of FIG. 3. The processor, memory, and interface of the controller 160 is described in greater detail below with respect to FIG. 2.

As described above, in certain embodiments, connections between various components of the HVAC system 100 are wired. For example, conventional cable and contacts may be used to couple the controller 160 to the various components of the HVAC system 100, including, the compressors 106*a,b*, sensors 114*a,b*, 118*a,b*, 132*a,b*, 136*a,b*, 137, the expansion valves 122*a,b*, the blower 144, sensor(s) 148, 150, 152, and thermostat(s) 154. In some embodiments, a wireless connection is employed to provide at least some of the connections between components of the HVAC system 100. In some embodiments, a data bus couples various components of the HVAC system 100 together such that data is communicated therebetween. In a typical embodiment, the data bus may include, for example, any combination of hardware, software embedded in a computer readable medium, or encoded logic incorporated in hardware or otherwise stored (e.g., firmware) to couple components of HVAC system 100 to each other. As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 160 to other components of the HVAC system 100.

In an example operation of HVAC system 100, the HVAC system 100 starts up to provide air conditioning to an enclosed space based on temperature setpoint 156. For example, in response to the indoor temperature exceeding the temperature setpoint 156, the controller 160 may cause one or both of the compressors 106*a,b* and the blower 144 to turn on to startup the HVAC system 100. The HVAC system 100 is generally operated in a normal air conditioning mode (e.g., associated with a CFM/ton value in a range from about 400 to 450 CFM/ton). If a refrigerant leak detected based on the sensor data received from the refrigerant leak detection sensor 137, the controller 160 may evaluate the SC signals 120*a,b*, SH signals 138*a,b*, and optionally SST signals 134*a,b* to determine whether any indication of loss of charge is detected for each compressor 106*a,b*. In some embodiments, if it is determined that an SC value is less than a threshold SC and an SH value is more than a threshold SH (and optionally SST value is less than a threshold SST), the controller 160 may determine that the respective compressor 106*a,b* is associated with the loss of charge and the refrigerant leak. In response, the controller 160 may isolate the identified compressor 106*a,b* and optionally close the shut-off valves outlet and/or inlet to the identified compressor 106*a,b*. The controller 160 may execute a mitigation plan to turn on the blower 144 and provide air conditioning with one or more other compressors 106 that are not associated with the loss of charge.

Example Refrigerant Leak Detection System

FIG. 2 illustrates an example embodiment of a system 200 configured to detect refrigerant leak at any component of the HVAC system 100 and provide air conditioning with one or more refrigeration circuits 206*a-b* during the refrigerant leak. In some examples, the components of the HVAC system 100 may include refrigeration circuits 206*a,b*, condenser 108*a,b*, evaporator 124*a,b*, among other component of the HVAC system 100 described in FIG. 1. In certain embodiments, the system 200 may include components of the HVAC system 100 described in FIG. 1, comprising a controller 240, refrigeration circuits 106*a,b*, condenser 108*a,b*, evaporator 124*a,b*, sensors 118*a, b*, 132*a, b*, 136*a, b*, and 137, and blower 114. The controller 240 corresponds to the controller 160 described in FIG. 1. In some embodiments of the HVAC system 100 of FIG. 1, the HVAC system 100 may include multiple refrigeration circuits 206*a-b* configured to provide air conditioning to a room where the HVAC system 100 is installed. Each refrigeration circuit 206 may include one or more compressors 106. For example, a first refrigeration circuit 206*a* may include one or more compressors 106*a* and a second refrigeration circuit 206*b* may include one or more compressors 106*b*. The first refrigeration circuit 206*a* may be configured to receive a first flow of a first refrigerant from a first evaporator coil and to discharge the first flow of refrigerant at a first higher pressure. The second refrigeration circuit 206*b* may be configured to receive a second flow of a second refrigerant from a second evaporator coil and to discharge the second flow of the second refrigerant at a second higher pressure. The controller 240 is in signal communication with each of the sensor circuits 118*a, b*, 132*a, b*, 136*a, b*, and 137, refrigeration circuits 206*a,b*, condenser 108*a,b*, evaporator 124*a,b*, and the blower 144 via wires and/or wireless connection.

In general, the system 200 improves the refrigeration technique by leveraging subcool (SC) values, superheat (SH) values, and (optionally) saturated suction temperature (SST) values to detect loss of charge, and in response, to determine that a set of conditions with respect to the SC, SH, and (optionally) SST values is met, determine a refrigeration circuit 206*a,b* that is associated with the loss of charge, isolate the refrigeration circuit 206*a,b* from other components of the HVAC system 100, execute a mitigation plan 262, and upon receiving an air conditioning demand, provide air conditioning by one or more other refrigeration circuits 206*a,b* that are not associated with loss of charge.

In HVAC systems, particularly in RTU A2L HVAC systems with multiple compressor circuits, when a refrigerant leak is detected, it is not known which compressor circuit is associated with the refrigerant leak since the leak detection sensor is in the space shared by all compressor circuits. As a result, when a refrigerant leak is detected, in one approach, the HVAC system is shut-down and stops air conditioning operations. However, this approach is not efficient. For example, switching off the cooling unit of the HVAC system leads to a temperature rise in a room where the HVAC system is deployed, and therefore, discomfort for the people in the room. In another example, not utilizing other compressor circuits that are not associated with a refrigerant leak reduces the utilization efficiency of those compressor circuits. The refrigerant may be flammable or at least mildly flammable, such as A2L, or toxic.

This disclosure contemplates an unconventional system and method configured to leverage subcool, superheat, and saturated suction temperature values associated with different refrigeration circuits 206*a, b* to detect which refrigeration circuit 206*a,b* is associated with the loss of charge and therefore the refrigerant leak. For example, if a refrigerant leak is detected, the system 200 may perform the following operations for each refrigeration circuit 206*a,b*. For example, for each refrigeration circuit 206*a,b*, the system 200 may determine whether a subcool value 250*a,b*, is less than a subcool threshold 252, a superheat value 254*a,b* is less than a superheat threshold 256, and optionally, if a saturation suction temperature 258*a,b* is less than an SST threshold 260. If these conditions are met, the system 200 may detect which refrigeration circuit 206*a,b* is associated with the loss of charge and therefore the refrigerant leak. The system 200 may then isolate the refrigeration circuit 206*a,b* which is associated with the loss of charge. The system 200 may also execute mitigation plan 262 to run/operate blower 144 to reduce the refrigerant concentration which is due to the refrigerant leak. Upon receiving a air conditioning request, the system 200 may provide air conditioning using one or more other refrigeration circuits 206*a,b* that are not associated with the loss of charge. The leak detection process and isolating the refrigeration circuit 206106 may not affect the air conditioning operations of the HVAC system 100. Thus, the HVAC system 100 is able to provide seamless air conditioning before, during, and after the detection of the leak. In other words, the HVAC system 100 takes the air conditioning operation load from the compressor 106 that is associated with the leak and puts on (e.g., balances, distributes) the air conditioning operation load onto compressor(s) 106 that are not associated with the refrigerant leak.

Accordingly, the disclosed system 200 provides a practical application of improving the refrigeration techniques by detecting which refrigeration circuit 206*a,b* is responsible for, associated with, and contributes to the loss of charge and refrigerant leak, isolating the identified refrigeration circuit 206*a,b*, and use other compressor circuit(s) 106*a,b* to provide air conditioning. The disclosed system 200 further provides an additional practical application of load balancing among the compressors 106*a,b*, where the air conditioning operation load is balanced among compressor(s) 106 that are not associated with refrigerant leak and taken from those compressors 106 that are associated with the refrigerant leak. The disclosed system 200 further provides an additional practical application of identifying a location where the refrigerant leak has occurred, and a component associated with the leak.

Refrigerant Detection Sensor

Sensor 137 may be a sensor circuitry that is configured to detect refrigerant concentration in a volume. For example, sensor 137 may include a circuit board comprising electronic devices and is configured to detect refrigerant particles in the air and monitor the presence of refrigerant particles (e.g., refrigerant gases) in the air. In some examples, each sensor 137 may be a gas sensor configured to detect refrigerant particles in the air. In some examples, sensor 137 may include a sensing element, such as transistors that when exposed to at least a threshold concentration 266 of refrigerant particles in the air (e.g., a number of refrigerant particles per unit space volume) may detect the presence of the refrigerant particles. Sensor 137 may detect the refrigerant leak from the refrigerant particles in the air when the detected concentration of refrigerant is more than the threshold concentration 266 of the refrigerant. For example, the threshold concentration 266 the refrigerant may be 10% of lower flammability limit (LFL), 12% of LFL, 15% of LFL, and the like. The sensor 137 may detect the refrigerant within its detection range. The detection range of the sensor 137 may be five inches, ten inches, twenty inches, and the like.

Certain properties of A2L refrigerants, such as flammability, may be related to how concentrated a given refrigerant is within a volume. To meet compliance standards, the system 200 may be configured to determine when an LFL of a refrigerant exceeds a threshold value within a specified period of time (e.g., within one minute, two minutes, etc.). The system 200 may further be configured to reduce the LFL of the refrigerant if there is a determination that the LFL exceeds the threshold value within a specified period of time.

In one example, the A2L refrigerant may be R454B. In this example, if it is determined that the A2L refrigerant concentration is at least 310 grams per one meter-cube, the LFL of the A2L refrigerant is 100%. Consequently, if a potential ignition source approaches the vicinity of the cubic meter containing the A2L refrigerant, it will give rise to combustion. Thus, it is desired to have the threshold concertation 266 at a much lower % LFL. In certain embodiments, one or more sensors 137 may be positioned at any location within the HVAC system 200. In certain embodiments, the one or more sensors 137 may detect refrigerant leak but because they are positioned in the space shared by multiple refrigeration circuits 206*a,b*, the data received from the sensors 137 may not indicate which refrigeration circuit 206*a,b* is associated with the leak.

Controller

The controller 240 may correspond to the controller 160 described in FIG. 1. Aspects of the controller 240 are described in FIG. 1, and additional aspects are described in FIG. 2. The controller 240 may be a computing device that is configured to perform one or more operations described herein. The controller 240 includes a processor 242 in signal communication with an Input/Output interface 244 and a memory 246. The components of the controller 240 are in signal communication with each other.

The processor 242 includes one or more processors operably coupled to the memory 246 and I/O interface 244. The processor 242 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 246 and controls the operation of refrigeration system 100. The processor 242 may be a programmable logic device, a microcontroller, a microprocessor, or any suitable combination of the preceding. The processor 242 is communicatively coupled to and in signal communication with the memory 246. The one or more processors are configured to process data and may be implemented in hardware or software. For example, the processor 242 may be 8-bit, 16-bit, 32-bit, 64-bit or of any other suitable architecture. The processor 242 may include an arithmetic logic unit (ALU) for performing arithmetic and logic operations, processor registers that supply operands to the ALU and store the results of ALU operations, and a control unit that fetches instructions from memory 246 and executes them by directing the coordinated operations of the ALU, registers, and other components. The processor 242 may include other hardware and software that operates to process information, control the refrigeration system 100, and perform any of the functions described herein (e.g., with respect to FIGS. 1-3) by executing the software instructions 249. The processor 242 is not limited to a single processing device and may encompass multiple processing devices. Similarly, the controller 240 is not limited to a single controller but may encompass multiple controllers.

The I/O interface 244 is configured to communicate data and signals with other devices. For example, the I/O interface 244 may be configured to communicate electrical signals with components of the refrigeration system 100 including the sensors 118*a,b*, 132*a,b*, and 136*a,b*, among other components. The I/O interface 244 may be configured to communicate with other devices and systems. The I/O interface 244 may provide and/or receive, for example, compressor speed signals, compressor on/off signals, temperature signals, pressure signals, temperature setpoints, environmental conditions, and an operating mode status for the refrigeration system 100 and send electrical signals to the components of the refrigeration system 100 and send alert signal to administrators, technicians, or other users. The I/O interface 244 may include ports or terminals for establishing signal communications between the controller 240 and other devices. The I/O interface 244 may be configured to enable wired and/or wireless communications.

The memory 246 may be a non-transitory computer-readable medium and include one or more disks, tape drives, or solid-state drives, and may be used as an over-flow data storage device, to store programs when such programs are selected for execution, and to store instructions and data that are read during program execution. The memory 246 may be volatile or non-volatile and may include ROM, RAM, ternary content-addressable memory (TCAM), dynamic random-access memory (DRAM), and static random-access memory (SRAM). The memory 246 is operable (e.g., or configured) to store information used by the controller 240 and/or any other logic and/or instructions for performing the function described in this disclosure. For example, the memory 246 may store instructions 248 for performing the functions of the controller 240 described in this disclosure. For example, when the instructions 248 are executed by the processor 242, the instructions 248 cause the processor 242 to perform one or more operations of the controller 240 described herein. The memory 246 may further store threshold concentration 266, subcool signals 150*a,b*, superheat signals 254*a,b*, saturation suction temperature 258*a,b*, sensor data 139, mitigation plan 262, subcool threshold 252, superheat threshold 256, SST threshold 260, switch-on command signal 270, configuration files 162, 164, and any other data/instruction. These components are described further below in conjunction with the operational flow of the system 200.

Operational Flow

The operational flow of the system 200 may begin when the controller 240 detects a refrigerant leak. In operation, the controller 240 may receive sensor data 139 from the refrigerant detection sensor circuit 137. The sensor data 139 may include data that indicates refrigerant concentration per volume value detected by the refrigerant detection sensor circuit 137. The refrigerant detection sensor circuit 137 may be positioned at any location within the HVAC system 100, for example, upstream a refrigeration circuit 206*a-c*, downstream a refrigeration circuit 206*a-c*, upstream the evaporator 116 (see FIG. 1), downstream the evaporator 116 (see FIG. 1), among other locations. The refrigerant detection sensor circuit 137 may be positioned in the space that is shared by multiple refrigeration circuits 206*a,b*.

The controller 240 may perform the following operations with respect to each refrigeration circuit 206*a,b*. In other words, the controller 240 may evaluate whether there is a refrigerant leak at each of the refrigeration circuits 206*a-c*. In this manner, the controller 240 may obtain information about the concentration of the refrigerant in volume. In certain embodiments, the refrigerant detection sensor circuit 137 may be configured to obtain information about the concentration of the refrigerant in volume from sensor data 139, compare the detected concentration of refrigerant with the threshold concentration 266, determine whether the detected concentration of refrigerant exceeds the threshold concentration 266, and communicate a signal indicating the result to the controller 240.

Determining Whether a Refrigerant Leak is Detected

In the example below, the controller 240 evaluates whether there is a refrigerant leak detected by the sensor 137. The controller 240 may compare the detected concentration of refrigerant received from the refrigerant detection sensor circuit 137 with the threshold concentration 266. The controller 240 may determine whether the detected concentration of refrigerant exceeds the threshold concertation 266. If it is determined that the detected concentration of refrigerant exceeds the threshold concentration 266, the controller 240 may determine that a refrigerant leak is detected. The controller 240 may perform the leak detection operation on multiple occasions whenever sensor data 139 is received. For example, the sensor data 139 may be received from the refrigerant detection sensors 137 every minute, every thirty seconds, every ten seconds, and the like. The controller 240 may preform similar operations to evaluate whether there is a refrigerant leak at refrigeration circuit 206*b*. In response to determining that the there is a refrigerant leak, the controller 240 may fetch the subcool values (indicated by the subcool signals 250*a,b*), superheat values (indicated by the superheat signals 254*a,b*), and saturation suction temperature values (indicated by the saturation suction temperature signals 258*a,b*) for all refrigeration circuits 206*a,b*. For example, the controller 240 may receive the SH signal 138*a* from the superheat sensor 136*a*, SH signal 138*b* from the superheat sensor 136*b*, SC signal 120*a* from subcool sensor 118*a*, SC signal 120*b* from subcool sensor 118*b*, SST signal 134*a* from SST sensor 132*a*, and SST signal 134*b* from SST sensor 132*b*. In one example, the subcool sensor 118*a,b* may comprise one or both of one or more temperature sensor circuits and one or more pressure sensor circuits located in or on an outlet line of the condenser 108*a,b*, respectively. In another example, the superheat sensor 136*a,b* may comprise one or both of one or more temperature sensor circuits and one or more pressure sensor circuits located in or on an outlet line of the evaporator 124*a,b*, respectively. The controller 160 may determine and evaluate each of the SC values, SH values, and SST values based on the configuration files 162, 164, similar to that described in FIG. 1. The controller 240 may determine the first subcool value associated with the compressor 106*a* from the SC signal 120*a*, the second subcool value associated with the compressor 106*b* from the SC signal 120*b*, the first superheat value associated with the compressor 106*a* from the SH signal 138*a*, the second superheat value associated with the compressor 106*b* from the SH signal 138*b*. In the example below, the controller 240 may evaluate the subcool, superheat, and saturation suction temperature values associated with the first compressor 106*a*.

Regarding the subcool value, the controller 240 may compare the first subcool value (associated with the SC signal 120*a*) with the subcool threshold 252. The subcool threshold 252 may be a range between 0 to 3° F. Regarding the superheat value, the controller 240 may compare the first superheat value (associated with the SH signal 138*a*) with the superheat threshold 256. The superheat threshold 256 may be a range between 25 to 30° F. In some embodiments, if the controller 240 determines that the first subcool values is less than the subcool threshold 252 and the first superheat value is more than the superheat threshold, the controller 240 may determine that the compressor 106*a* is associated with the loss of charge. In other words, if these conditions are met, the controller 240 may determine that refrigerant may be leaking from the refrigeration circuit 206*a*.

In some embodiments, optionally, the controller 240 may use the saturation suction temperature values as an additional factor in evaluating whether there is loss of charge. For example, if the controller 240 determines that the first saturation suction temperature value (associated with the first saturation suction temperature signal 258*a*) is less than the SST threshold 26 (e.g., of about 35 to 40° F.), in addition to determining that the first subcool values are less than the subcool threshold 252 and the first superheat value is more than the superheat threshold, the controller 240 may determine that the refrigeration circuit 206*a* is associated with the loss of charge.

In response, the controller 240 may isolate the refrigeration circuit 206*a* from other components of the HVAC system 100. In this operation, for example, the controller 240 may switch off the compressor(s) 106*a* included in the refrigeration circuit 206*a* by sending shut-off command signal 268 to the compressor(s) 106*a*. In another example, the controller 240 may switch off the refrigeration circuit 206*a* by sending shut-off command signal 268 to the refrigeration circuit 206*a*. In another example, the controller 240 may close the shut-off valves outlet and/or inlet to the compressor 106*a* included in the refrigeration circuit 206*a*. In another example, the controller 240 may close the shut-off valves in the liquid line near the indoor evaporator coil associated with the evaporator 124*a*. In another example, the controller 240 may close shut-off valves located upstream of the expansion device near the inlet of the evaporator coil associated with the evaporator 124*a*. In another example, the controller 240 may close the shut-off valves outlet and/or inlet to the refrigeration circuit 206*a*. The controller 240 may execute mitigation plan 262 to dilute the leak of the refrigerant associated with and/or from the refrigeration circuit 206*a*. The mitigation plan 262 may include turning on the blower 114 (e.g., by sending the switch-on command signal 270 to the blower 114). Additionally, the mitigation plan 262 may include switching off the compressor(s) 106*a* if it is/they are energized, for example, by sending the shut-off command signal 268 to the compressor(s) 106*a*.

If the controller 240 receives a request to provide air conditioning (e.g., from a user), the controller 240 may turn on the refrigeration circuit 206*b*, for example, by sending a switch-on command signal 272 to the refrigeration circuit 206*b* to provide air conditioning in response to an air conditioning demand. If the controller 240 was already providing air conditioning when the refrigerant leak is detected, the controller 240 may continue to provide air conditioning using the refrigeration circuit 206*b* without the refrigeration circuit 206*a*. In other words, the controller 240 may continue its operation (e.g., air conditioning and other operations) with non-leaking refrigeration circuits 206. In this manner, the controller 240 is configured to detect the location where the leak has occurred, a component associated with the leak, and address the leak.

In certain embodiments, a processor (e.g., similar to processor 242) may be integrated and embedded within the refrigerant detection sensor 137. In such embodiments, the refrigerant detection sensor 137 may be configured with the threshold concentration 266 and indicate information about whether the refrigerant concentration is more than the threshold concentration 266 in sensor data 139. For example, when a refrigerant concentration more than the threshold concentration 266 is detected by the sensor 137, the refrigerant detection sensor 137 may include a signal (e.g., a flag bit) indicating that an above-threshold concentration is detected to the controller 240 in the sensor data 139, respectively. Otherwise, if the refrigerant detection sensor 137 detects that the refrigerant concentration is less than the threshold concentration 266, the refrigerant detection sensor 137 may include a signal indicating that a less than the threshold concentration 266 of refrigerant is detected to the controller 240 in the sensor data 139, respectively. In response to receiving the sensor data 139 indicating that above the threshold concentration 266 of refrigerant is detected, the controller 240 may execute the mitigation plan 262 and other operations similar to that described above.

Example Method for Leveraging SC, SH, and SST Values in Detecting and Addressing Refrigerant Leak FIG. 3 illustrates an example method 300 of system 200 of FIG. 2 for leveraging SC, SH, and SST values in detecting and addressing refrigerant leak, according to some embodiments. Modifications, additions, or omissions may be made to method 300. Method 300 may include more, fewer, or other operations. For example, operations may be performed in parallel or in any suitable order. While at times discussed as the system 100, system 200, controller 240, or components of any of thereof performing operations, any suitable system or components of the system may perform one or more operations of the method 300. In certain embodiments, a processor (e.g., a processor embedded inside the sensor 132*a-c* and/or the processor 242) may perform one or more operations of the method 300. For example, one or more operations of method 300 may be implemented, at least in part, in the form of software instructions 248 of FIG. 2, stored on a non-transitory computer-readable medium (e.g., memory 246 of FIG. 2) that when run by one or more processors (e.g., processor 242 of FIG. 2) may cause the one or more processors to perform operations 302-318.

At operation 302, the controller 240 determines whether refrigerant leak is detected. For example, the controller 240 may receive sensor data 139 from the refrigerant detection sensor circuit 137 and determine whether the detected refrigerant concentration (indicated in the sensor data 139) is more than the threshold concentration 266. If it is determined that the refrigerant concentration is more than the threshold concentration 266, the controller 240 may determine that there is refrigerant leak within the HVAC system 100. If it is determined that a refrigerant leak is detected, method 300 proceeds to operation 304. Otherwise, method 300 may remain at operation 302 and the controller 240 may continue to monitor the sensor data 139. At operation 304, the controller 240 accesses the SST, SC, and SH values associated with the refrigeration circuits 206*a,b*. For example, the controller 240 may obtain and determine the SST, SC, and SH values from the SST signals 134*a,b*, SC signals 120*a,b*, and SH signals 138*a,b*, and configuration files 162, 164, respectively, similar to that described in FIGS. 1 and 2. At operation 306, the controller 240 executes the mitigation plan 262, similar to that described in FIGS. 1 and 2.

At operation 308, the controller 240 selects a refrigeration circuit 206*a,b*. The controller 240 may iteratively select a refrigeration circuit 206*a,b* until no refrigeration circuit is left for evaluation. For example, assume that the controller 240 selects the refrigeration circuit $^{206a}$.

At operation 310, the controller 240 determines whether the SC value (associated with the refrigeration circuit 206*a*) is less than the SC threshold 252. If it is determined that the SC value is less than the SC threshold 252, the method 300 may proceed to operation 312. Otherwise, the method 300 may return to operation 302. For example, the SC value associated with the SC signal 120*a* may be evaluated and compared with the SC threshold 252.

At operation 312, the controller 240 determines whether the SH value (associated with the refrigeration circuit 206*a*) is greater than the SH threshold 256. If it is determined that the SH value is greater than the SH threshold 256, the method 300 may proceed to operation 314. Otherwise, the method 300 may return to operation 302. For example, the SH value associated with the SH signal 138*a* may be evaluated and compared with the SH threshold 256.

At operation 314, the controller 240 isolates the refrigeration circuit 206*a* from other components of the HVAC system 100, similar to that described in FIGS. 1 and 2.

At operation 316, the controller 240 determines whether to select another refrigeration circuit 206. If at least one refrigeration circuit 206 is left for evaluation, the controller 240 determines to select another refrigeration circuit 206. If at least one refrigeration circuit 206 is left for evaluation, method 300 may return to operation 308. Otherwise, method 300 may proceed to operation 318.

At operation 318, the controller 240 continues the air conditioning operation with non-leaking refrigeration circuit (s) 206*a,b* or non-leaking compressor circuits 106*a,b*, similar to that described in FIGS. 1 and 2.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated with another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112 (f) as it exists on the date of filing hereof unless the words "means for" or "step for" are explicitly used in the particular claim.

The invention claimed is:

1. A heating, ventilation, and air conditioning (HVAC) system configured to regulate a temperature of a space, the HVAC system comprising:

a set of refrigeration circuits comprising a first refrigeration circuit with one or more first compressors and a second refrigeration circuit with one or more second compressors, wherein:

the first refrigeration circuit is configured to receive a first flow of a first refrigerant from a first evaporator coil and to discharge the first flow of refrigerant at a first higher pressure than it was received;

the second refrigeration circuit is configured to receive a second flow of a second refrigerant from a second evaporator coil and to discharge the second flow of the second refrigerant at a second higher pressure than it was received;

a condenser configured to receive the first refrigerant and cool the first refrigerant flowing through;

a subcool sensor circuit configured to provide a subcool signal that indicates a subcool value associated with the condenser, wherein the subcool value corresponds to a temperature difference between a saturated refrigerant and a subcooled refrigerant associated with the condenser;

a superheat sensor circuit configured to provide a superheat signal that indicates a superheat value corresponding to a temperature difference between a superheated refrigerant and a saturated refrigerant associated with the first evaporator;

a refrigerant detection sensor circuit configured to detect a concentration of the first refrigerant in a volume; and a processor operably coupled with the refrigerant detection sensor circuit, the subcool sensor circuit, and the superheat sensor circuit, and configured to:

obtain information related to the detected concentration of the first refrigerant in the volume;

compare the detected concentration of the first refrigerant with a threshold concentration; and determine that the detected concentration of the first refrigerant exceeds the threshold concentration;

in response to determining that the detected concentration of the first refrigerant exceeds the threshold concentration:

receive the subcool signal from the subcool sensor circuit;

determine the subcool value based at least in part upon the subcool signal;

receive the superheat signal from the superheat sensor circuit;

determine the superheat value based at least in part upon the superheat signal;

determine that the subcool value is less than a threshold subcool value; and determine that the superheat value is more than a threshold superheat value;

in response to determining that the subcool value is less than the threshold subcool value and that the superheat value is more than the threshold superheat value:

determine that the first refrigerant is leaking from the first refrigeration circuit;

isolate the first refrigeration circuit from other components of the HVAC system;

execute a mitigation plan to dilute the leak of the first refrigerant from the first refrigeration circuit; and operate the second refrigeration circuit to provide air conditioning in response to an air conditioning demand.

2. The HVAC system of claim 1, further comprising a blower positioned in a duct system, wherein the blower is configured to move airflow across an indoor coil and out of the duct system.

3. The HVAC system of claim 2, wherein the mitigation plan comprises:

turning off the first refrigeration circuit; and turning on the blower.

4. The HVAC system of claim 1, wherein isolating the first refrigeration circuit comprises turning off the one or more first compressors.

5. The HVAC system of claim 1, wherein isolating the first refrigeration circuit comprises closing a shut-off valve located in a liquid line near an indoor evaporator coil.

6. The HVAC system of claim 1, wherein the subcool sensor circuit comprises one or both of one or more temperature sensor circuits and one or more pressure sensor circuits located in or on an outlet line of the condenser.

7. The HVAC system of claim 1, wherein the superheat sensor circuit comprises one or both of one or more temperature sensor circuits and one or more pressure sensor circuits located in or on an outlet line of the first evaporator.

8. A method of operating a heating, ventilation, and air conditioning (HVAC) system configured to regulate a temperature of a space, the method comprising:

obtaining information related to a detected concentration of a first refrigerant in a volume;

comparing the detected concentration of the first refrigerant with a threshold concentration; and determining that the detected concentration of the first refrigerant exceeds the threshold concentration;

in response to determining that the detected concentration of the first refrigerant exceeds the threshold concentration:

receiving a subcool signal from a subcool sensor circuit, wherein:

the subcool signal indicates a subcool value;

a subcool value corresponds to a temperature difference between a saturated refrigerant and a subcooled refrigerant associated with a condenser;

the condenser is configured to receive the first refrigerant and cool the first refrigerant flowing through;

a first refrigeration circuit is configured to receive a first flow of the first refrigerant from a first evaporator coil and to discharge the first flow of refrigerant at a first higher pressure than it was received; and the first refrigeration circuit comprises one or more first compressors;

determining the subcool value based at least in part upon the subcool signal;

receiving a superheat signal from a superheat sensor circuit, wherein the superheat signal indicates a superheat value corresponding to a temperature difference between a superheated refrigerant and a saturated refrigerant associated with an evaporator;

determining the superheat value based at least in part upon the superheat signal;

determining that the subcool value is less than a threshold subcool value; and determining that the superheat value is more than a threshold superheat value;

in response to determining that the subcool value is less than the threshold subcool value and that the superheat value is more than the threshold superheat value:

determining that the first refrigerant is leaking from the first refrigeration circuit;

isolating the first refrigeration circuit from other components of the HVAC system;

executing a mitigation plan to dilute the leak of the first refrigerant from the first refrigeration circuit; and operating a second refrigeration circuit to provide air conditioning in response to an air conditioning demand.

9. The method of claim 8, wherein the HVAC system comprises a blower positioned in a duct system, wherein the blower is configured to move airflow across an indoor coil and out of the duct system.

10. The method of claim 9, wherein the mitigation plan comprises:

turning off the first refrigeration circuit; and turning on the blower.

11. The method of claim 8, wherein isolating the first refrigeration circuit comprises turning off one or more first compressors associated with the first refrigeration circuit.

12. The method of claim 8, wherein isolating the first refrigeration circuit comprises closing a shut-off valve located in a liquid line near an indoor evaporator coil.

13. The method of claim 8, wherein the subcool sensor circuit comprises one or both of one or more temperature sensor circuits and one or more pressure sensor circuits located in or on an outlet line of the condenser.

14. The method of claim 8, wherein the refrigerant is flammable, an A2L refrigerant, or toxic.

15. A non-transitory computer-readable medium storing instructions that when executed by a processor, cause the processor to:

obtain information related to a detected concentration of a first refrigerant in a volume;

compare the detected concentration of the first refrigerant with a threshold concentration; and determine that the detected concentration of the first refrigerant exceeds the threshold concentration;

in response to determining that the detected concentration of the first refrigerant exceeds the threshold concentration:

receive a subcool signal from a subcool sensor circuit, wherein:

the subcool signal indicates a subcool value;

the subcool value corresponds to a temperature difference between a saturated refrigerant and a subcooled refrigerant associated with a condenser;

the condenser is configured to receive the first refrigerant and cool the first refrigerant flowing through;

a first refrigeration circuit is configured to receive a first flow of the first refrigerant from a first evaporator coil and to discharge the first flow of refrigerant at a first higher pressure than it was received; and the first refrigeration circuit comprises one or more first compressors;

determine the subcool value based at least in part upon the subcool signal;

receive a superheat signal from a superheat sensor circuit, wherein the superheat signal indicates a superheat value corresponding to a temperature difference between a superheated refrigerant and a saturated refrigerant associated with an evaporator;

determine the superheat value based at least in part upon the superheat signal;

determine that the subcool value is less than a threshold subcool value; and determine that the superheat value is more than a threshold superheat value;

in response to determining that the subcool value is less than the threshold subcool value and that the superheat value is more than the threshold superheat value:

determine that the first refrigerant is leaking from the first refrigeration circuit;

isolate the first refrigeration circuit from other components of a heating, ventilation, and air conditioning (HVAC) system;

execute a mitigation plan to dilute the leak of the first refrigerant from the first refrigeration circuit; and operate a second refrigeration circuit to provide air conditioning in response to an air conditioning demand.

16. The non-transitory computer-readable medium of claim 15, wherein the HVAC system comprises a blower positioned in a duct system, wherein the blower is configured to move airflow across an indoor coil and out of the duct system.

17. The non-transitory computer-readable medium of claim 16, wherein the mitigation plan comprises:

turning off the first refrigeration circuit; and turning on the blower.

18. The non-transitory computer-readable medium of claim 15, wherein isolating the first refrigeration circuit comprises turning off the one or more first compressors.

19. The non-transitory computer-readable medium of claim 15, wherein isolating the first refrigeration circuit comprises closing one or more shut-off valves located in a liquid line near an indoor evaporator coil.

20. The non-transitory computer-readable medium of claim 15, wherein the refrigerant is flammable, an A2L refrigerant, or toxic.

* * * * *